US011299331B2

(12) United States Patent
Künzler

(10) Patent No.: US 11,299,331 B2
(45) Date of Patent: Apr. 12, 2022

(54) CONTAINER

(71) Applicant: HOLOPACK VERPACKUNGSTECHNIK GMBH, Sulzbach-Laufen (DE)

(72) Inventor: Werner Künzler, Walzenhausen (CH)

(73) Assignee: HOLOPACK VERPACKUNGSTECHNIK GMBH, Sulzbach-Laufen (DE)

( * ) Notice: Subject to any disclaimer, the term of this patent is extended or adjusted under 35 U.S.C. 154(b) by 13 days.

(21) Appl. No.: 16/960,610

(22) PCT Filed: Jan. 18, 2019

(86) PCT No.: PCT/EP2019/051202
§ 371 (c)(1),
(2) Date: Jul. 8, 2020

(87) PCT Pub. No.: WO2019/154608
PCT Pub. Date: Aug. 15, 2019

(65) Prior Publication Data

US 2020/0399033 A1 Dec. 24, 2020

(30) Foreign Application Priority Data

Feb. 9, 2018 (DE) ..... 10 2018 001 102.0

(51) Int. Cl.
*B65D 51/22* (2006.01)
*B65D 41/34* (2006.01)
*B65D 51/24* (2006.01)

(52) U.S. Cl.
CPC ..... *B65D 51/222* (2013.01); *B65D 41/3409* (2013.01); *B65D 51/245* (2013.01);
(Continued)

(58) Field of Classification Search
CPC ..... B65D 51/222; B65D 41/3409; B65D 51/245; B65D 2251/0015;
(Continued)

(56) References Cited

U.S. PATENT DOCUMENTS 4,307,821 A * 12/1981 McIntosh ..... B65D 41/3442 222/83
5,040,692 A 8/1991 Julian
(Continued)

FOREIGN PATENT DOCUMENTS

DE 10 2005 025 760 12/2006
DE 10 2013 007 063 10/2014
(Continued)

OTHER PUBLICATIONS

International Search Report (ISR) dated Aug. 28, 2019 in International (PCT) Application No. PCT/EP2019/051202.

*Primary Examiner* — Shawn M Braden
(74) *Attorney, Agent, or Firm* — Wenderoth, Lind & Ponack, L.L.P.

(57) ABSTRACT

A container of a plastic material has a container body (1) for receiving a fluid and a neck part (7) adjoining the container body (1). The neck part (7) has at its free end a discharge opening for the fluid closed by a head part (11) and covered by a cap (19). The cap (19) interacts with individual blocking elements via a retaining ring (21), starting from an attachment position of the cap (19). Rotary motions in both directions of rotation are permitted along a predetermined path of travel. During a further screw-on motion beyond the predetermined path of travel, a part of second blocking elements completely passes over assigned first blocking elements, and in so doing the head part (11) is penetrated by the opening part of the cap (19). During a subsequent unscrewing motion of the cap (19) for the purpose of releasing the discharge opening, the retaining ring (21) is
(Continued)

disengaged from the cap (19) and, in the process, is secured on the neck part (7) at least temporarily against rotation in the unscrewing direction by at least one blocking element.

20 Claims, 4 Drawing Sheets

(52) U.S. Cl.
CPC ..... *B65D 2251/0015* (2013.01); *B65D 2251/0096* (2013.01)

(58) Field of Classification Search
CPC .... B65D 2251/0096; B65D 2251/0056; B65D 2251/0025
See application file for complete search history.

(56) References Cited

U.S. PATENT DOCUMENTS

| | | | | |
|---|---|---|---|---|
| 5,197,620 | A | 3/1993 | Gregory | |
| 5,203,838 | A * | 4/1993 | Schneider ..... | B65D 51/222 215/253 |
| 5,590,798 | A | 1/1997 | O'Connell | |
| 5,954,233 | A | 9/1999 | Kawashima et al. | |
| 2004/0200855 | A1 * | 10/2004 | Weiler ..... | B65D 51/225 222/83 |
| 2005/0279761 | A1 * | 12/2005 | Weiler ..... | B65D 51/226 222/83 |
| 2005/0279791 | A1 | 12/2005 | Weiler et al. | |
| 2008/0073348 | A1 | 3/2008 | Pritikin et al. | |
| 2009/0230080 | A1 * | 9/2009 | Hansen ..... | B65D 51/226 215/316 |
| 2010/0224657 | A1 | 9/2010 | Bowman | |
| 2016/0200491 | A1 | 7/2016 | Dubach | |

FOREIGN PATENT DOCUMENTS

| | | |
|---|---|---|
| EP | 0 471 629 | 2/1992 |
| WO | 2014/169979 | 10/2014 |
| WO | 2015/032754 | 3/2015 |

* cited by examiner

CONTAINER

FIELD OF THE INVENTION

The invention relates to a container of a plastic material, having a container body for receiving a fluid and having a neck part adjoining the container body. The neck part has at its free end a discharge opening for the fluid, which opening is closed by a head part and covered by a cap. The cap penetrates the head part by at least one opening part during a screw-on motion in one direction of rotation and is connected to a retaining ring, forming a unit with the cap. Via a connection device and after the connection device has been disengaged, the cap releases the discharge opening for removing fluid via the penetrated head part in the course of an unscrewing motion in the opposite direction of rotation and on removal from the container body. Individual blocking elements projecting outwards are provided on the neck part. The blocking elements interact with individual second blocking elements projecting inwards on the retaining ring in such a way that the connection device is disengaged when the unit is rotated from an attachment position on the neck part.

BACKGROUND OF THE INVENTION

Plastic containers of this type are known. Such containers can be produced in a simple and cost-effective manner by a blow molding, filling and sealing process (BFS process), as it is known to experts as Bottelpack® (trademark). The unit comprising cap and retaining ring can preferably be produced by injection molding. As relevant state of the art, WO 2014/169979 A1 discloses a container of the genus mentioned above.

In particular, if such containers are intended to receive a sensitive filling material, such as food or in particular pharmaceutical or cosmetic substances, the retaining ring, which is separated from the cap by disconnecting the connection device, when the cap is rotated starting from the attachment position of the unit, i.e. for the first use of the container, is of particular importance. Because the detachment of the retaining ring from the rest of the unit provides a clear indication that the opening/closure system has been actuated, the retaining ring has the function of a quality assurance device to indicate or even prevent possible manipulation.

SUMMARY OF THE INVENTION

Based on this prior art, the invention addresses the problem of providing a container of the type mentioned, which is characterized by improved ease of use, while maintaining the advantages achieved in the prior art.

According to the invention, this problem is basically solved by a container, having as an essential feature of the invention, blocking elements that interact in such a way that rotary motions in both directions of rotation along a predetermined path of travel are permitted starting from the attachment position. A part of the second blocking elements passes completely over the first blocking elements during a further screw-on motion of the unit beyond the predetermined path of travel. In so doing, the head part is penetrated by the respective opening part of the cap. The connection device is disengaged during a subsequent unscrewing motion of the cap in order to release the discharge opening. The retaining ring thereby is secured on the neck part at least partially against rotation by at least one blocking element.

Because according to the invention, when the unit formed by the cap and retaining ring is arranged in its attachment position, i.e. the container is in the condition as supplied to customer, a path of travel for rotational motions is available for the user for the initial opening before the connection device on the retaining ring is disconnected. The opening process is then safer and more user-friendly compared to the known container solution mentioned. For the known container, the blocking elements on the container neck and on the retaining ring engage each other in such a way that there is practically no free angle of rotation before the connection device is disconnected, i.e. the retaining ring is detached.

For the opening process by penetration of the head part, the user has to rotate the cap in the direction of rotation that produces the screw-on motion. There is a risk that the user will stop the rotary motion before the head part is completely penetrated and remove the cap by unscrewing it without actually opening the container. The invention precludes the risk that the user is left with a closed container after the cap has been removed and the quality assurance device has been detached, because the user has a path of travel available to him for the screw-on motion penetrating the head part, in which a complete penetration of the opening part of the cap on the head part occurs. Because the retaining ring is secured against rotation on the neck part of the container during the subsequent rotation in the unscrewing direction performed by the user to remove the cap, the quality assurance device is now deactivated by disconnecting the connection device, so that after unscrewing the cap the container is available to the user in a safely opened state.

In advantageous embodiments, the first blocking elements of the neck part are formed by the ends of ramps that protrude beyond the outer circumference of the neck part. The second blocking elements of the retaining ring have individual, inclined bars on the inner circumferential side of the retaining ring. While the ramps permit the second blocking elements to be passed over when rotated in the screw-on direction, the ends of the ramps simultaneously form blocking surfaces which, after being passed over, secure the retaining ring against rotation in the unscrewing direction by contacting the respective second blocking element.

The arrangement can be advantageously made in such a way that the second blocking elements of the retaining ring are combined in pairs to form fixing groups and that every second blocking element is at a distance from the further second blocking element of a fixing group. The distance is equal to or greater than the longitudinal extension of a ramp as viewed in the circumferential direction of the neck part.

The blocking elements of the fixing groups are advantageously positioned on the retaining ring in such a way that, during the screw-on motion of the cap starting from the attachment position, the blocking element of a fixing group arranged adjacent to a ramp of the neck part slides along the ramp until the ramp, completely passed by this blocking element, comes into latching engagement with the associated fixing group of second blocking elements.

In advantageous embodiments, the neck part forms an annular body in the direction of the container body. The annular body supports the individual ramps, which are arranged equidistantly from one another along the outer circumference of the annular body. The annular body, on its side facing away from the container body, has a stop surface for the free end face of the cap. The cap comes into contact with the stop surface as soon as the respective opening part has penetrated the head part.

When the cap is screwed on in the direction of the stop surface, the cap entrains the retaining ring via the connection device. The retaining ring moves coaxially with the longitudinal axis of the container body in the direction of the container body axially along the annular body until the cap abuts against the annular body.

Advantageously, the neck part has a multi-start thread between the head part and the annular body which, formed as an external thread, interacts with an internal thread on the inner side of the cap for screw-on and unscrewing operations. With special advantage, the external thread can have a saw-tooth shape, which permits attaching the unit of the cap and retaining ring by snapping it onto the external thread, but still secures the unit against any axial motion away from the neck part.

In advantageous embodiments, the head part, which is cylindrical in shape, adjoins the external thread of the neck part via an extraction cone. The free end face of the head part, formed in the manner of a membrane, can be penetrated by the opening part in the form of a mandrel in the cap.

With particular advantage, the cylindrical outer circumferential surface of the head part serves as a guide surface for a guide body of the cap, which guide body encompasses the mandrel at the rim.

As an assembly aid when attaching the closure system to the container, the retaining ring can have a marking on the outer circumference. The marking can be brought into alignment with a marking on the container body in such a way that the unit on the neck part assumes its predeterminable attachment position, in which the fixing groups of the retaining ring are guided in the circumferential area between the ramps of the neck part, freely movable back and forth in opposite directions of rotation.

The connection device between the retaining ring and the cap can be implemented by predetermined breaking points, which act, as projecting predetermined breaking webs having a reduced cross-section, on the outer circumference of the cap until the connection device is disconnected.

The unit comprising the cap, the retaining ring and the connection device may be formed from an one-piece plastic molding, in particular an injection-molded part.

In particularly advantageous embodiments, the retaining ring has support struts on the inner circumference and outside of the fixing groups and the predetermined breaking bars. The support struts, preferably starting from an upper annular surface of the retaining ring, extend axially up to a length such that, in the attachment position of the unit below the support struts, a moving space remains free for the ramps of the neck part inside the retaining ring.

The arrangement can be advantageously made in such a way that when the container body is turned and the container opening is released, the retaining ring slides down from the neck part and detaches from the container, which may be advantageous for reasons of hygiene.

In addition, the arrangement can be such that a longitudinal channel extends through the external thread of the neck part in parallel to the longitudinal axis of the container body at least one location. The longitudinal channel preferably crosses the thread path and, serving for air exchange, permits the screw on processes on and the screw off processes from the neck part for the cap without restraint.

In a particularly advantageous manner, the filled container body together with the neck part and the head part can be manufactured by a blow molding, filling and sealing process.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
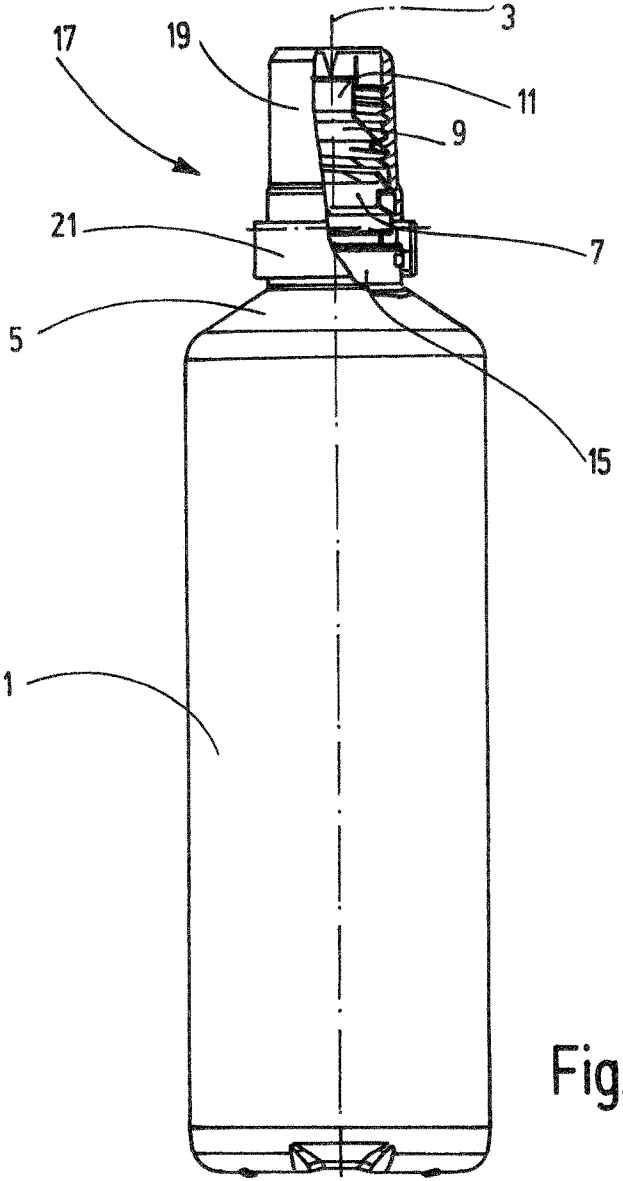
FIG. 1 is a side view of a container according to an exemplary embodiment of the invention, wherein a unit of cap and retaining ring is shown partially cut away in the longitudinal direction.
Figure 3:
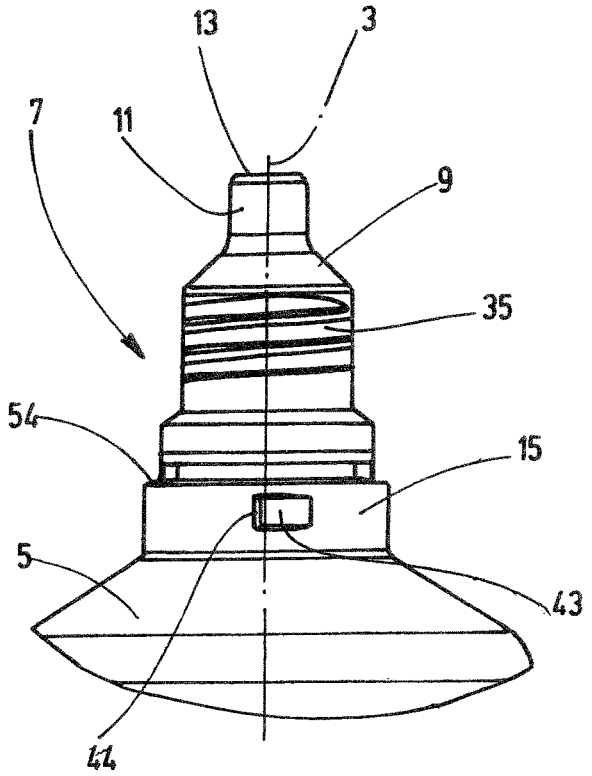
FIGS. 3 and 4 are partial side views of the neck part adjoining the container body of the exemplary embodiment, wherein two rotational positions of the container offset by 90° from each other are shown.
Figure 4:
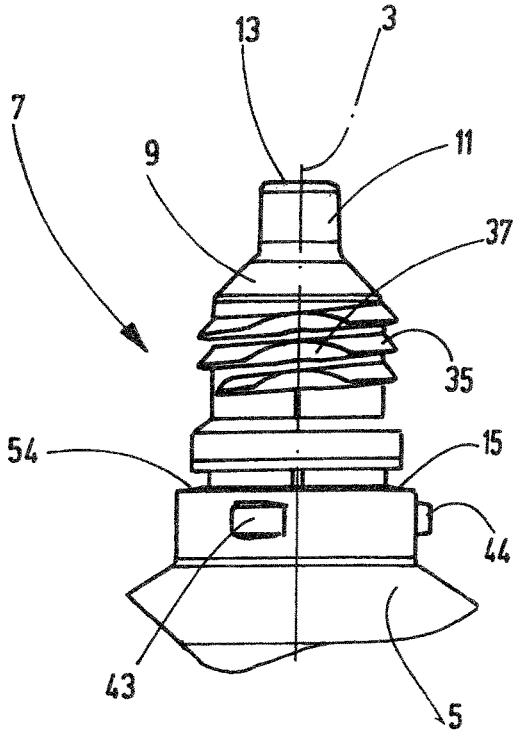
Figure 5:
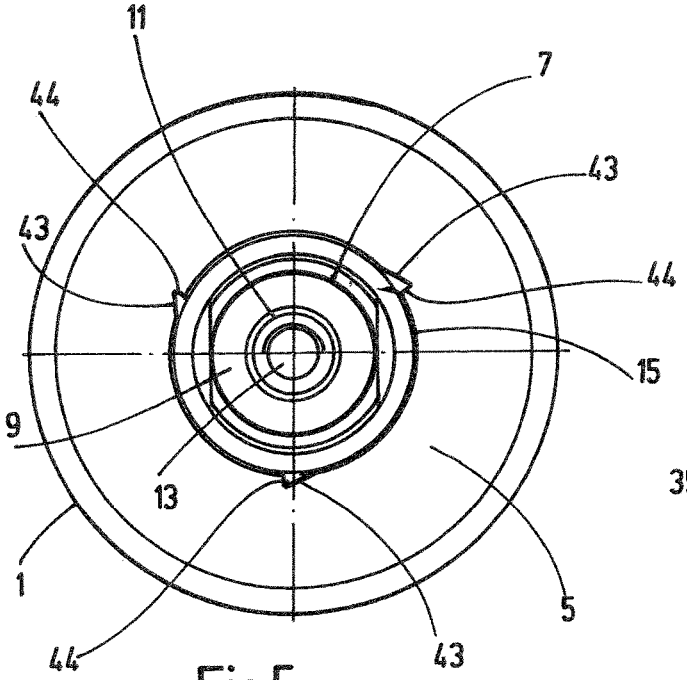
FIG. 5 is a top plan view of the container with the unit removed.
Figure 6:
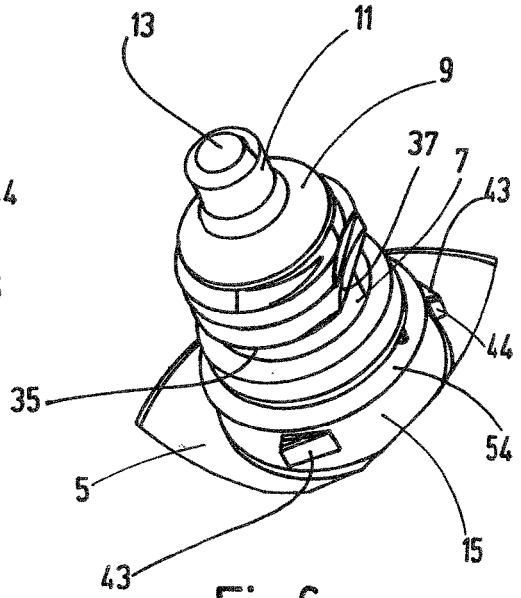
FIG. 6 is a perspective view of the neck part of the container, without the unit attached.

The exemplary embodiment of the container according to the invention and shown in FIG. 1 has a container body 1, which has a substantially circular cylindrical shape having a vertical axis 3. A neck part 7 adjoins the end area 5 of the body 1, which end area is located at the top of the figure and tapers in diameter. The details of the neck part 7 can be most clearly seen in FIGS. 3 to 6. As shown, a tapering extraction cone 9 adjoins the free end of the neck part 7, which in turn merges into a circular cylindrical head part 11. The free end face of the head part 11 is closed by a membrane 13, which is one-piece with the head part 11 and can be penetrated to open the container. As can be seen in FIGS. 3 to 6 as well, the transition from the end area 5 of the container body 1 to the neck part 7 is formed by a circular cylindrical annular body 15, which has a larger diameter than the adjoining end area of the neck part 7 above the annular body 15.

Figure 7:
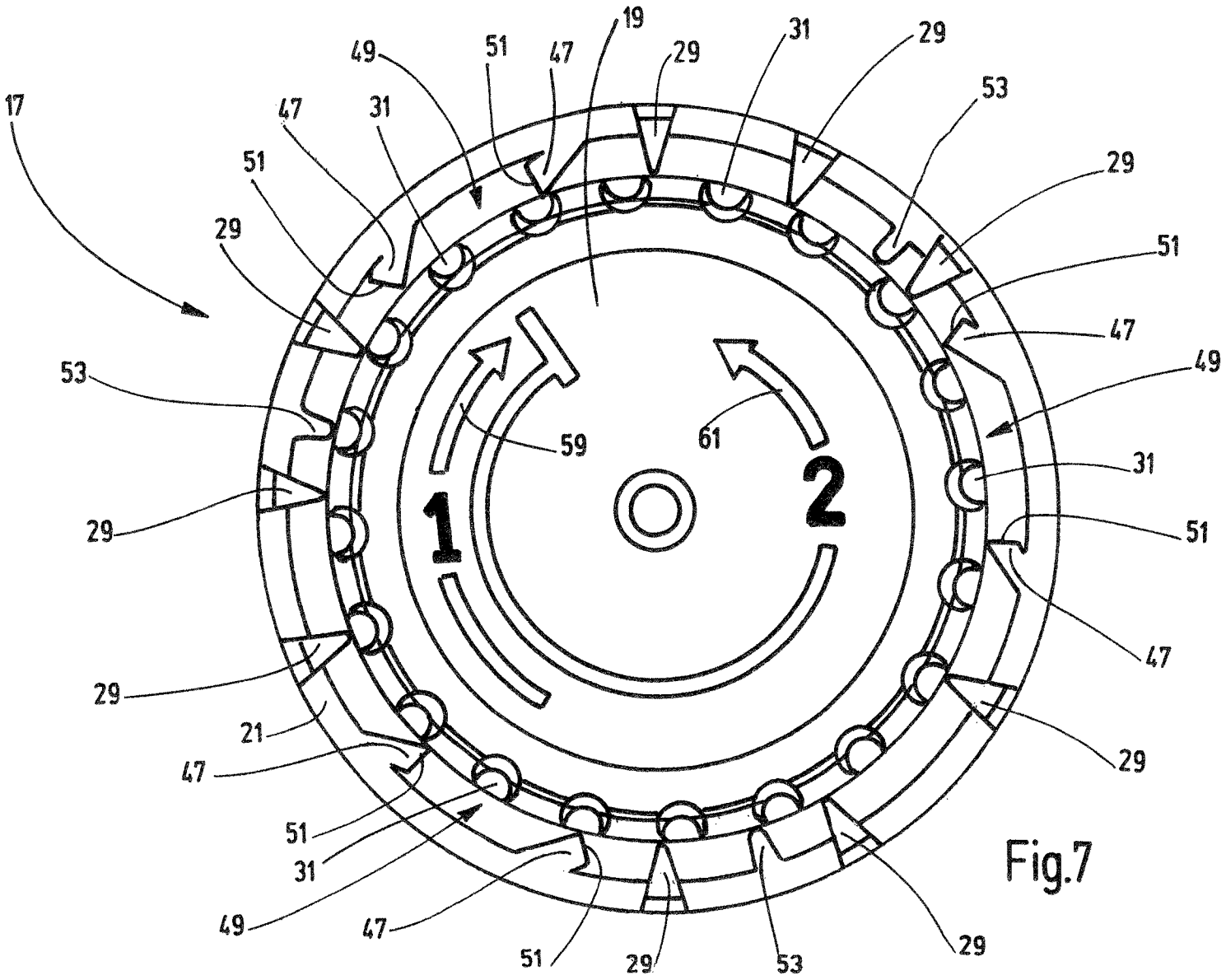
FIG. 7 is a top plan view of the exemplary embodiment of the container drawn on a larger scale.

A unit 17 comprising a cap 19 is provided as an opening system by which the container can be opened by penetrating the membrane 13 and can be re-closed. As shown most clearly in FIG. 2, the cap 19 has the shape of a pot having a closed pot bottom 23 at the top of the figure and a side wall 25. Side wall 25 extends almost circularly cylindrical from the bottom end of the pot, to be more precise, tapering at only a very small cone angle, to the pot bottom 23. A retaining ring 21 completing the unit 17 is detachably connected to the lower rim of the cap 19 via predetermined breaking points 27. As FIG. 7 shows, the predetermined breaking points 27 are formed by an annulus of webs 29, which extend from the upper rim of the retaining ring 21 to the lower rim of the cap 19. The webs 29 taper towards the connection point with the cap 19. As FIG. 7 also shows, the cap 19 has a longitudinal corrugation 31 on the outside, only part of which is numbered in FIG. 7 for clarity purposes. To form a screw connection between unit 17 and neck part 7, the cap 19 has an internal thread 33 and the neck part 7 has an external thread 35 adjoining the extraction cone 9. The threads of the external thread 35 have a sawtooth shape so that the internal thread 33 of the cap 19 can be engaged with the external thread 35 by snapping it on without rotary motion. To ensure that the attaching and the screw-on and unscrewing operations can be performed without restraint, a longitudinal channel 37 (FIGS. 4 and 6) is formed for air exchange by chamfering the threads on the external thread 35. As an opening part for penetrating the diaphragm 13, a mandrel 39 (FIG. 2) is provided which protrudes coaxially from the inside of the pot bottom 23 of the cap 19 and is surrounded by a guide body 41, which has the shape of a coaxial hollow cylinder. In this arrangement, the circular cylindrical peripheral surface of the head part 11 in interaction with the guide body 41 forms an axial guide for the cap 19.

Figure 2:
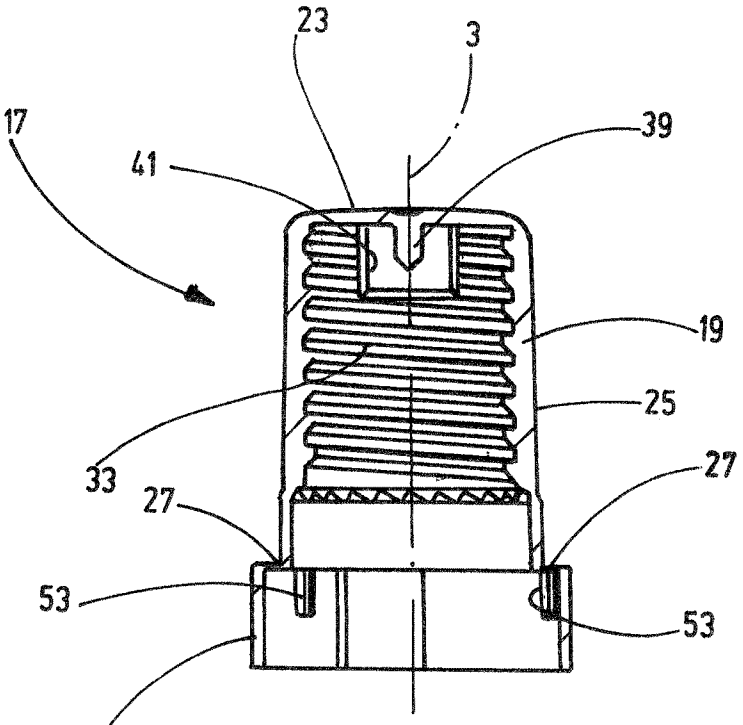
FIG. 2 is a side view in section of the unit of the cap and retaining ring drawn on a larger scale compared to FIG. 1.
Figure 9:
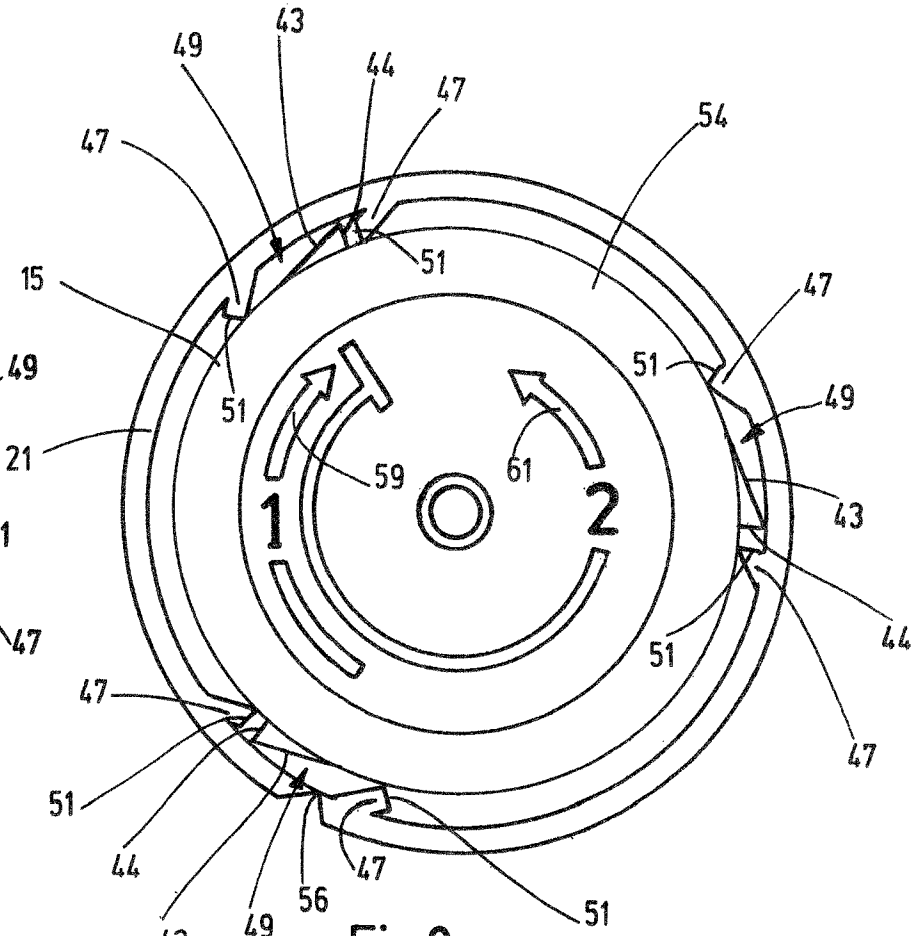
FIGS. 8 and 9 are simplified functional top plan view sketches in which the unit is shown in the attachment position and in a position rotated relative to the neck part, respectively, to illustrate the interaction of blocking elements.
Figure 8:
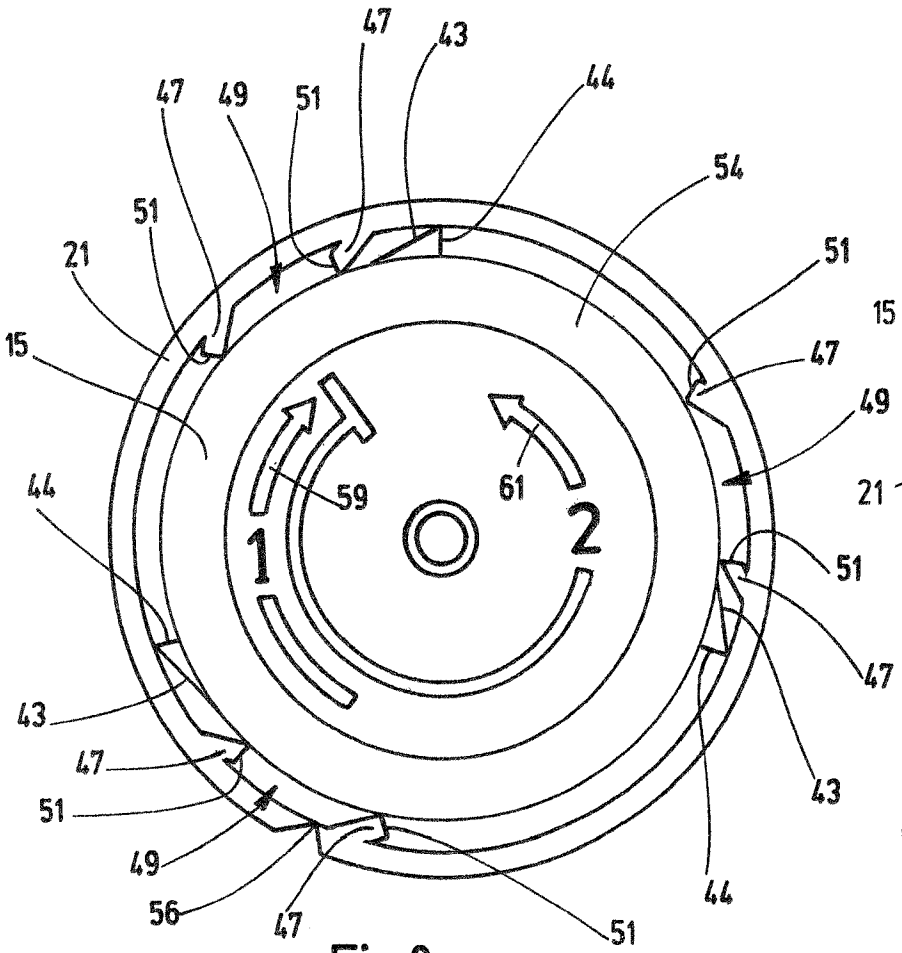

As part of a quality assurance device, the opening device of the container on the annular body 15 of the neck part 7 has as first blocking elements three ramps 43 arranged at equal angular distances from each other. The ramps 43 project beyond the outer circumference of the annular body 15 and rise accordingly, in the direction of vision according to FIG. 5, up to one end 44. Each end 44 extends in a radial plane forming the stop surface of the first blocking elements. FIG. 7, in which unit 17 is shown separately and in plan view, and FIGS. 8 and 9 show the construction of the second blocking elements of the quality assurance device assigned to the retaining ring 21. As shown, the second blocking elements are formed by three pairs of blocking elements 47, each pair forming a fixing group 49. The blocking bodies 47 projecting obliquely from the inner circumference of the retaining ring 21 each form a blocking surface 51, which is opposite from the ends 44 of the ramps 43. Regarding the fixing groups 49, which are arranged at equal angular distances from each other, the distance between the blocking bodies 47 measured in the circumferential direction is slightly greater than the length of the ramps 43 in the circumferential direction. As FIGS. 2 and 7 show, the unit 17 is completed by three support struts 53 arranged at equidistant angular intervals. Starting from the upper rim of the retaining ring 21, support struts 53 extend in a direction parallel to the axis 3 on the inside of the retaining ring 21 only about half the axial length of the retaining ring 21, so that a space below the support struts 53 remains free for rotational motions of the ramps 43. As only shown in FIGS. 8 and 9, there is a marking 56 in the form of a notch on the outer circumference of the retaining ring 21. When assembling the unit 17, this notch, by aligning with a (not shown) marking on the container body 1, defines the attachment position of the unit 17. In the attachment position, as shown in FIG. 8, the ramps 43 are located in the free circumferential area between successive fixing groups 49. As further markings there are direction of rotation arrows 59 and 61 as visual markings on the upper side of the cap 19.

For the opening procedure the user rotates the cap 19 in accordance with the direction of the first rotation arrow 59 starting from the attachment position (FIG. 8) in the screw-on direction. In doing so, the mandrel 39 penetrates the diaphragm 13 of the head part 11. Also, the second blocking element 47, which is always ahead in the direction of rotation, passes over the respective first blocking element by sliding on the ramp 43 until the ramp 43 comes into latching engagement with the matching fixing group 49 and the lower face of the cap 19 comes to rest against a stop surface 54 formed by the lower rim of the annular body 15. For the removal of the unit 17 for the purpose of releasing the container opening formed by the mandrel 39, the user rotates the cap 19 in the unscrewing direction indicated by the second rotation arrow 61. The retaining ring 21 in interaction with the relevant locking surface 51 of the locking body 47 of the second blocking elements is secured against co-rotation, so that the predetermined breaking points 27 are torn off and the quality assurance device is detached. After removing the cap 19, the container is available to the user in the opened state for dispensing the container contents. When the container body 1 is turned over to withdraw fluid, the now free retaining ring 21 slides down from the neck part 7. If necessary, the cap 19 can be used to re-close the container.

While one embodiment has been chosen to illustrate the invention, it will be understood by those skilled in the art that various changes and modifications can be made therein without departing from the scope of the invention as defined in the claims.

The invention claimed is:

1. A container of plastic material, comprising:

a container body capable of receiving fluid;

a neck part adjoining the container body and having a free end with a discharge opening for fluid in the container body, the discharge opening being closed by a head part;

a cap covering the head part and having an opening part capable of penetrating the head part during a screw-on motion in first rotational direction;

a retaining ring being connected to the cap by a connector and forming a unit with the cap, the connector permitting the retaining ring to be disengaged from the end cap to release the discharge opening for removing fluid from the discharge opening after penetration of the head part by the opening part and after unscrewing of the cap in a second rotational direction opposite the first rotational direction and removal of the cap from the container body;

individual first blocking elements projecting outwards on the neck part and interacting with individual second blocking elements projecting inwards on the retaining ring such that the connector is disengaged from the cap when the unit is rotated starting from an attachment position on the neck part, the first and second blocking elements interacting such that rotary motions in the first and second rotational directions along a predeterminable path of travel are permitted starting from the attachment position, parts of the second blocking elements completely passing over the first blocking elements during a further screw-on motion of the unit beyond the predeterminable path of travel causing the opening part to penetrate the head part;

an annular body being on the neck part in a direction of the container body and supporting individual first ramps, the first ramps forming the first blocking elements and being equally spaced from one another along an outer circumference of the annular body, ends of the first ramps protruding beyond the outer circumference of the annular body; and a stop surface being on the annular body on a side thereof facing away from the container body and being contacted by a free end of the cap as soon as the opening part has penetrated the head part, the cap entraining the retaining ring by the connector and the retaining ring moving coaxially along a longitudinal axis of the container body in a direction of the container body until the cap abuts against the annular body when the cap is screwed-on in a direction of the stop surface, the connector disengaging the retainer ring from the cap during a subsequent unscrewing motion of the cap releasing the discharge opening and securing the retaining ring on the neck part at least temporarily against rotation in the unscrewing direction by at least one of the second blocking elements.

2. A container according to claim 1 wherein the second blocking elements comprise individual inclined bars on an inner circumferential side of the retaining ring.

3. A container according to claim 1 wherein the second blocking elements are combined in pairs forming fixing groups, each of the second blocking elements being spaced at a distance from the other second blocking element in each of the fixing groups, the distance between the second blocking elements of each of the fixing groups being equal to or greater than a longitudinal extension of each of the first ramps in a circumferential direction of the neck part.

4. A container according to claim 3 wherein the second blocking elements adjacent to the first ramps slide along the first ramps until the first ramps completely pass the second blocking elements and come into latching engagement with the fixing groups.

5. A container according to claim 1 wherein the neck part has multi-start thread being between the head part and the annular body and being an external thread interacting with an internal thread on an inside of the cap for screw-on and unscrewing operations.

6. A container according to claim 5 wherein the head part comprises a cylindrical outer circumferential surface adjoining the external thread on the neck part via an extraction cone;

the head part closing the discharge opening comprises a membrane; and the opening part comprises a mandrel.

7. A container according to claim 6 wherein the cap comprises a guide body encompassing the mandrel and receiving the outer circumferential surface guiding the mandrel to the membrane.

8. A container according to claim 3 wherein an outer circumference of the retaining ring comprises a ring marking capable of being brought into alignment with a body marking on the container body aligning the unit on the neck part in a predetermined attachment position in which the fixing groups on the retaining ring are guided in a circumferential area between the first ramps on the neck part and freely movable in opposite directions of rotation.

9. A container according to claim 1 wherein the connector comprises predetermined breaking webs projecting and having reduced cross sections on an outer circumference of the cap.

10. A container according to claim 1 wherein the unit of the cap, the retaining ring and the connector are formed of a one-piece plastic injection molded part.

11. A container according to claim 3 wherein the retaining ring comprises support struts on an inner circumference of the retaining ring outside of the fixing groups and comprises predetermined breaking bars forming the connector on the inner circumference of retaining ring, the support struts extend from an upper annular surface of the retaining ring axially to a length providing a moving space below the support struts remaining free for the first ramps of the neck part inside the retaining ring.

12. A container according to claim 1 wherein the retaining ring is slidable down from and off of the neck part to be detached from the container when the container body is turned and the discharge opening is released.

13. A container according to claim 1 wherein the neck part comprises an external thread having a longitudinal channel through and across the external threads parallel to the longitudinal axis of the container body at at least one location, providing an air exchange permitting screw-on and screw off processes of the cap relative to the neck part without restraint.

14. A container according to claim 1 wherein the container body is capable of being with the neck part and the head part and being filled by a blow molding, filling and sealing process.

15. A container of plastic material, comprising:

a container body capable of receiving fluid;

a neck part adjoining the container body and having a free end with a discharge opening for fluid in the container body, the discharge opening being closed by a head part;

a cap covering the head part and having an opening part capable of penetrating the head part during a screw-on motion in first rotational direction;

a retaining ring being connected to the cap by a connector and forming a unit with the cap, the connector permitting the retaining ring to be disengaged from the end cap to release the discharge opening for removing fluid from the discharge opening after penetration of the head part by the opening part and after unscrewing of the cap in a second rotational direction opposite the first rotational direction and removal of the cap from the container body;

individual first blocking elements projecting outwards on the neck part and interacting with individual second blocking elements projecting inwards on the retaining ring such that the connector is disengaged from the cap when the unit is rotated starting from an attachment position on the neck part, the first and second blocking elements interacting such that rotary motions in the first and second rotational directions along a predeterminable path of travel are permitted starting from the attachment position, parts of the second blocking elements completely passing over the first blocking elements during a further screw-on motion of the unit beyond the predeterminable path of travel causing the opening part to penetrate the head part;

the connector disengaging the retainer ring from the cap during a subsequent unscrewing motion of the cap releasing the discharge opening and securing the retaining ring on the neck part at least temporarily against rotation in the unscrewing direction by at least one of the second blocking elements;

a multi-start thread on the neck part being between the head part and an annular body on the neck part in a direction of the container body and being an external thread interacting with an internal thread on an inside of the cap for screw-on and unscrewing operations.

16. A container according to claim 15 wherein an outer circumference of the retaining ring comprises a ring marking capable of being brought into alignment with a body marking on the container body aligning the unit on the neck part in a predetermined attachment position in which the fixing groups on the retaining ring are guided in a circumferential area between the first ramps on the neck part and freely movable in opposite directions of rotation.

17. A container according to claim 15 wherein the neck part comprises an external thread having a longitudinal channel through and across the external threads parallel to the longitudinal axis of the container body at at least one location, providing an air exchange permitting screw-on and screw off processes of the cap relative to the neck part without restraint.

18. A container of plastic material, comprising:

a container body capable of receiving fluid;

a neck part adjoining the container body and having a free end with a discharge opening for fluid in the container body, the discharge opening being closed by a head part;

a cap covering the head part and having an opening part capable of penetrating the head part during a screw-on motion in first rotational direction;

a retaining ring being connected to the cap by a connector and forming a unit with the cap, the connector permitting the retaining ring to be disengaged from the end cap to release the discharge opening for removing fluid from the discharge opening after penetration of the head part by the opening part and after unscrewing of the cap in a second rotational direction opposite the first rotational direction and removal of the cap from the container body;

individual first blocking elements projecting outwards on the neck part and interacting with individual second blocking elements projecting inwards on the retaining ring such that the connector is disengaged from the cap when the unit is rotated starting from an attachment position on the neck part, the first and second blocking elements interacting such that rotary motions in the first and second rotational directions along a predeterminable path of travel are permitted starting from the attachment position, parts of the second blocking elements completely passing over the first blocking elements during a further screw-on motion of the unit beyond the predeterminable path of travel causing the opening part to penetrate the head part;

the connector disengaging the retainer ring from the cap during a subsequent unscrewing motion of the cap releasing the discharge opening and securing the retaining ring on the neck part at least temporarily against rotation in the unscrewing direction by at least one of the second blocking elements;

the second blocking elements being combined in pairs forming fixing groups, each of the second blocking elements being spaced at a distance from the other second blocking element in each of the fixing groups, the distance between the second blocking elements of each of the fixing groups being equal to or greater than a longitudinal extension of each of the first ramps in a circumferential direction of the neck part; and an outer circumference of the retaining ring including a ring marking capable of being brought into alignment with a body marking on the container body aligning the unit on the neck part in a predetermined attachment position in which the fixing groups on the retaining ring are guided in a circumferential area between the first ramps on the neck part and freely movable in opposite directions of rotation.

19. A container according to claim 18 wherein the neck part comprises an external thread having a longitudinal channel through and across the external threads parallel to the longitudinal axis of the container body at at least one location, providing an air exchange permitting screw-on and screw off processes of the cap relative to the neck part without restraint.

20. A container of plastic material, comprising:

a container body capable of receiving fluid;

a neck part adjoining the container body and having a free end with a discharge opening for fluid in the container body, the discharge opening being closed by a head part;

a cap covering the head part and having an opening part capable of penetrating the head part during a screw-on motion in first rotational direction;

a retaining ring being connected to the cap by a connector and forming a unit with the cap, the connector permitting the retaining ring to be disengaged from the end cap to release the discharge opening for removing fluid from the discharge opening after penetration of the head part by the opening part and after unscrewing of the cap in a second rotational direction opposite the first rotational direction and removal of the cap from the container body;

individual first blocking elements projecting outwards on the neck part and interacting with individual second blocking elements projecting inwards on the retaining ring such that the connector is disengaged from the cap when the unit is rotated starting from an attachment position on the neck part, the first and second blocking elements interacting such that rotary motions in the first and second rotational directions along a predeterminable path of travel are permitted starting from the attachment position, parts of the second blocking elements completely passing over the first blocking elements during a further screw-on motion of the unit beyond the predeterminable path of travel causing the opening part to penetrate the head part;

the connector disengaging the retainer ring from the cap during a subsequent unscrewing motion of the cap releasing the discharge opening and securing the retaining ring on the neck part at least temporarily against rotation in the unscrewing direction by at least one of the second blocking elements; and the neck part including an external thread having a longitudinal channel through and across the external threads parallel to the longitudinal axis of the container body at at least one location, providing an air exchange permitting screw-on and screw off processes of the cap relative to the neck part without restraint.

* * * * *